US005737279A

United States Patent [19]

Carter

[11] Patent Number: 5,737,279

[45] Date of Patent: Apr. 7, 1998

[54] RETRACTABLE SENSOR ARRAY SYSTEM

[75] Inventor: G. Clifford Carter, Waterford, Conn.

[73] Assignee: The United States of America as represented by the Secretary of the Navy, Washington, D.C.

[21] Appl. No.: 695,844

[22] Filed: Aug. 7, 1996

[51] Int. Cl.[6] ..... H04R 17/00; H04R 23/00

[52] U.S. Cl. ..... 367/173; 367/153; 367/155; 367/165; 367/169; 310/337; 310/800

[58] Field of Search ..... 367/173, 153, 367/155, 165, 169; 310/337, 800

[56] References Cited

U.S. PATENT DOCUMENTS

| | | | |
|---|---|---|---|
| 3,990,123 | 11/1976 | Stachiw et al. | 367/173 |
| 3,992,737 | 11/1976 | Duel et al. | 367/165 |
| 4,298,964 | 11/1981 | Warnshuis, Jr. et al. | 367/4 |
| 5,197,036 | 3/1993 | Buckingham | 367/4 |
| 5,257,243 | 10/1993 | DeChico et al. | 367/169 |
| 5,452,266 | 9/1995 | Carter | 367/153 |
| 5,602,801 | 2/1997 | Nussbaum et al. | 367/165 |

*Primary Examiner*—J. Woodrow Eldred

*Attorney, Agent, or Firm*—Michael J. McGowan; James M. Kasischke; Prithvi C. Lall

[57] ABSTRACT

A retractable sensor array system is used to provide a large aperture sensor array, such as a sonar array, that receives acoustic energy in a deployment medium. The retractable sensor array system includes one or more sensor array sheets having one or more sensors and a sensor array positioning mechanism for deploying and retracting the sensor array sheet from a platform, such as a ship, submarine, aircraft, space vehicle or medical device. The sensor array positioning mechanism preferably includes a motor that automatically and selectively deploys and retracts the one or more sensor array sheets by rolling and unrolling the sensor array sheets. The retractable sensor array system allows the one or more sensor array sheets to be deployed from various locations on a platform and also in various directions from the platform depending upon the desired usage, platform orientation, position and deployment medium conditions. Each sensor array sheet includes a sensor array sheet support member, that urges and supports the sheet in a deployed position.

17 Claims, 3 Drawing Sheets

RETRACTABLE SENSOR ARRAY SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to an easily deployed, large aperture sensor array.

(2) Description of the Prior Art

Underwater sensors, such as hydrophones, are used to detect or receive underwater acoustic energy or signals. A sonar system, for example, uses sensors to receive underwater acoustic energy and then processes the received signals for detection, classification and localization. One advantageous way of receiving underwater acoustic energy or signals is with a large aperture underwater sensor array. By increasing the physical aperture of a sensor array, e.g., the horizontal, vertical or volumetric dimensions, the performance of a sonar system or other similar system is enhanced.

Existing sonar systems, for example, commercial fishing sonar or medical ultra-sonic sonar, either actively receive reflected acoustic signals or passively (non-invasively) receive acoustic signals from a source. The performance of such sonar systems is limited by the size of the receiving or sensor arrays that passively or actively receive the energy. Particularly in complex environments, such as shallow water (e.g., fishing banks), there is a need for a large aperture sensor array with a relatively large vertical extent.

Large aperture sensor arrays are disclosed in U.S. Pat. No. 5,257,243 and U.S. Pat. No. 4,376,302. None of the prior art, however, discloses a large aperture sensor array that can be easily deployed and retracted in an underwater environment and can extend in various directions with respect to an underwater vehicle, such as a fishing boat, submarine, torpedo, and the like.

SUMMARY OF THE INVENTION

One object of the present invention is to provide a large aperture sensor array that is easily deployed and retracted from a platform, such as a surface ship, submarine, sonobuoy, mine, spaceship, airplane, unmanned underwater vehicle, or other device.

Another object of the present invention is to provide a plurality of retractable underwater sensor arrays that extend from a vehicle in a number of different directions.

A further object of the present invention is to provide a retractable underwater sensor array that maximizes the detection and receipt of underwater acoustic energy or signals in an underwater environment while also reducing hydrostatic drag against the sensor array created by ocean currents or motion through the water.

The present invention features a retractable underwater sensor array system for use by a platform, such as an underwater vehicle, to receive acoustic energy in an underwater or other type of environment. The retractable underwater sensor array system comprises at least one sensor array sheet having at least one sensor element disposed on at least one surface and a sensor array positioning mechanism, coupled to the sensor array sheet, for deploying and retracting the sensor array sheet into the underwater environment. According to a preferred embodiment, the sensor array sheet is a polymer sheet. In one example, the sensor elements include a plurality of hydrophones.

The retractable sensor array system further includes at least one sensor array sheet support member, coupled to an end of the sensor array sheet for supporting the sensor array sheet in an extended relation with respect to the platform. One example of the sensor array sheet support member includes a weighted support member for supporting the sensor array sheet in a substantially downwardly extending vertical direction in the environment. Another example of the sensor array sheet support member includes a flotation support member for supporting the sensor array sheet in a substantially upwardly extending vertical direction in the environment.

According to a preferred embodiment, the sensor array sheet is formed as a roll located in the platform or other storage device. The sensor array positioning mechanism deploys the sensor array sheet by unrolling the sensor array sheet, and retracts the sensor array sheet by rolling the sensor array sheet. For example, the sensor array positioning mechanism includes a rolling mechanism coupled to at least one end of the sensor array sheet, for rolling and unrolling the sensor array sheet. The sensor array positioning mechanism preferably includes a motor, coupled to the rolling mechanism for automatically rolling and unrolling the sensor array sheet.

One embodiment of the sensor array sheet includes a series of sensor array sheets. A further embodiment includes a first sensor array sheet extending in a substantially upward direction with respect to the storage platform and a second sensor array sheet extending in a substantially downward direction with respect to the storage platform. A further example includes a first sensor array sheet extending from a starboard side of the storage platform and a second sensor array sheet extending from a port side of the storage platform, either in an upward, downward, or horizontal direction.

In a further embodiment, the sensor array sheet includes one or more holes extending through the sensor array sheet, for reducing dynamic drag in the deployment medium such as in a marine or aerospace environment.

The retractable underwater sensor array system further includes a signal processor, coupled to each sensor element disposed on the sensor array sheet, for processing signals transmitted from each of the sensor elements. A controller is coupled to control the signal processor. The controller is also coupled to the retraction means, for controlling deployment and retraction of the sensor array sheet.

BRIEF DESCRIPTION OF THE DRAWINGS

These and other features and advantages of the present invention will be better understood in view of the following description of the invention taken together with the drawings wherein.

DESCRIPTION OF THE PREFERRED EMBODIMENT

Figure 1:
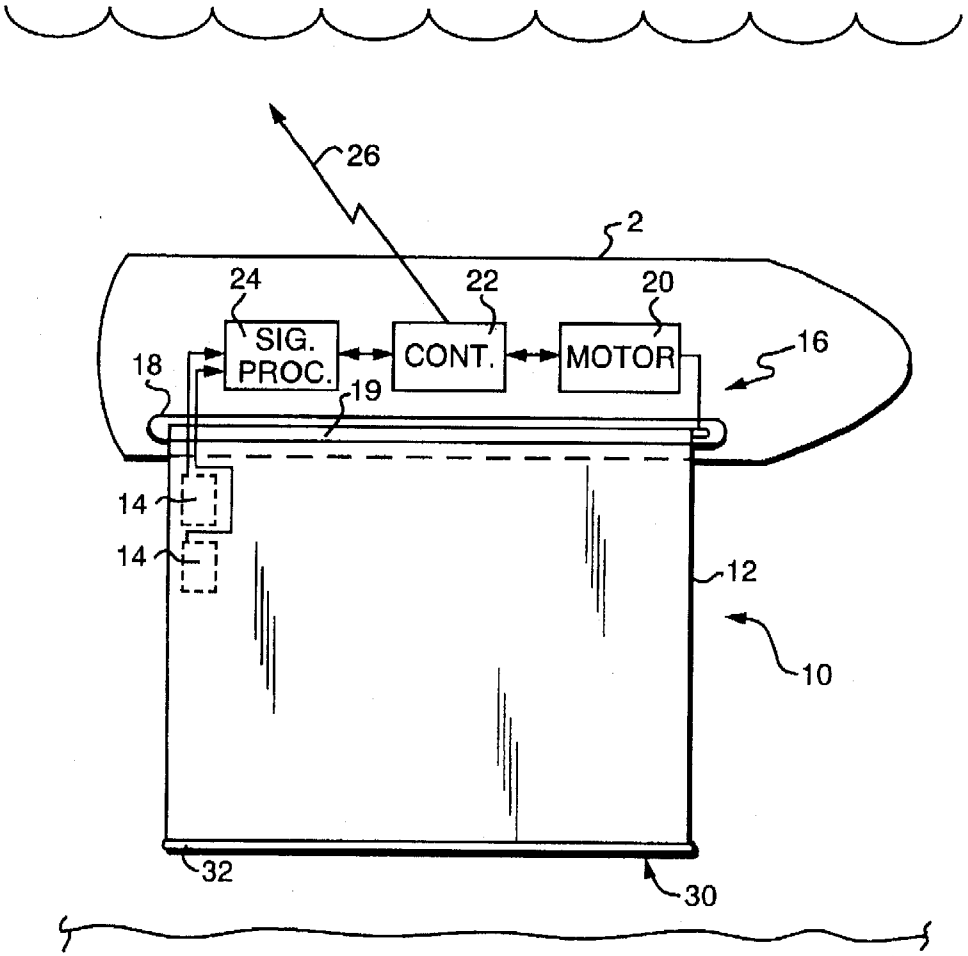
FIG. 1 is a schematic view of a retractable sensor array system, according to the present invention.

A retractable sensor array system 10, FIG. 1, provides for the receipt of acoustic energy or other signals in any medium, such as water, air, or outer space, for further processing of the received signals, for signal detection, classification and localization. In one example, the retractable sensor array system 10 is used in a sonar system, to either actively receive reflected active acoustic signals or passively receive energy radiated in the form of heat or acoustics. Sonar systems are typically used on a deployment platform 2 such as an underwater platform on a surface ship, submarine, sonobuoy, mine or unmanned underwater vehicle for detection, classification and localization of underwater energy sources, such as sound sources. Although other platforms such as medical devices, airplanes, and spaceships are considered to be within the scope of the present invention.

The retractable sensor array system 10 includes one or more sensor array sheets 12 having one or more sensor elements 14 such as acoustic signal sensors, solar cells, fiber optic sensors, etc., affixed thereon or embedded therein. The retractable sensor array system 10 further includes an array positioning mechanism 16 that deploys and retracts the sensor array sheet 12 from the underwater platform 2. The array positioning mechanism 16 is used to selectively deploy and retract the one or more sensor array sheets 12 depending upon the required usage.

According to a preferred embodiment, the sensor array sheet 12 is a polymer sheet, preferably made of polyvinyl chloride (PVC) and 1/32 of an inch thick that can easily be rolled and unrolled by the array positioning mechanism 16, similar to a window shade. Other polymer sheets that are suitable for the sensor array sheet 12 include, but are not limited to Mylar, nylon and other flexible materials. Sensor 14 can be embedded in the material and are not limited to electronic sensors. The retractable sensor array system 10 preferably includes a cylindrical stowage tube 18 into which the sensor array sheet 12 is rolled when the sensor array sheet 12 is retracted and not being used.

According to the preferred embodiment, the retractable sensor array system 10 further includes one or more sensor array sheet support members 30. In one example, the sensor array sheet support member 30 includes one or more weighted members 32 made of a dense material such as lead. Each member weighs approximately one pound and pulls the sensor array sheet 12 in a substantially downward direction so that the sensor array sheet 12 is held in an extended relation with respect to the underwater platform 2. A strength member such as nylon, Kevlar or carbon can be embedded in the polymer sheet to reinforce the strength of the polymer sheet.

The sensor array sheet 12 preferably provides a large aperture sensor array that enhances the performance of a sonar or other system. The vertical and horizontal extent of the sensor array sheet 12 is important to provide the large aperture array. The sensor array sheet support member 30 facilitates the extension of the sensor array sheet 12 in a plane to maximize the physical aperture of the array.

Figure 2:
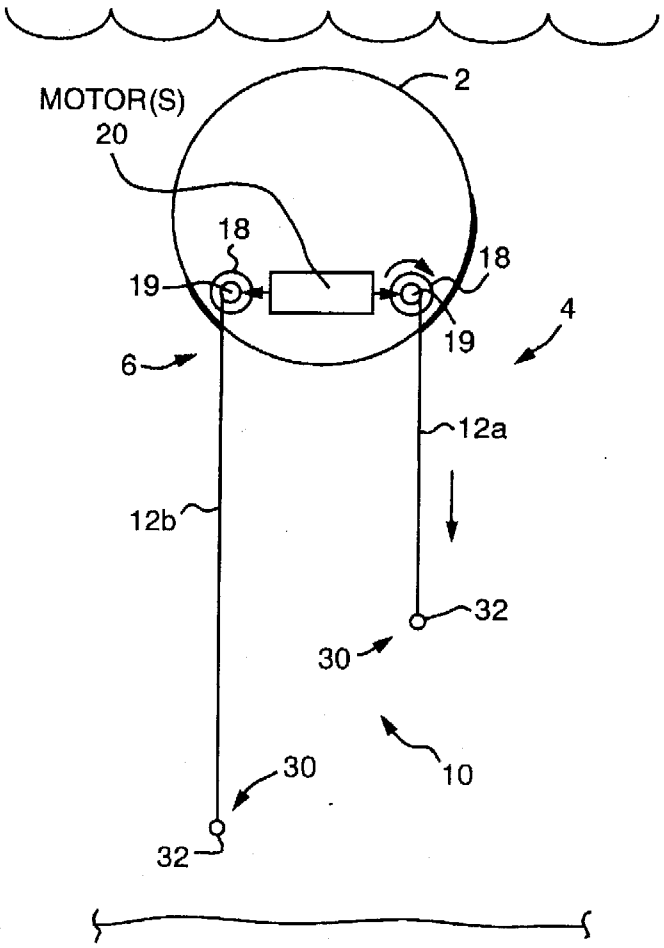
FIG. 2 is a rear schematic view of the retractable sensor array system, according to the present invention, having two sensor array sheets, according to one embodiment of the present invention.

Referring now to FIG. 2, the array positioning mechanism 16 preferably includes a rolling member 19 and a motor 20 that rotates the rolling member 19 to deploy and retract the sensor array sheet 12 by unrolling and rolling the sensor array sheet 12 which is attached at one end to the rolling member 19. Referring now to FIG. 1, the retractable sensor array system 10 preferably includes a controller 22, such as a central control computer, coupled to the motor 20 for controlling and monitoring the deployment and retraction of the sensor array sheet 12 depending upon the desired usage. The controller 22 may be local or remote from the sensor array system 10.

The retractable sensor array system 10 can also include a signal processor 24 coupled and responsive to each sensor element 14 affixed on or embedded in the sensor array sheet 12. The signal processor 24 provides processing of the received signals, such as detection, classification and localization of the signals. The signal processor 24 is also preferably coupled to the controller or central computer 22. In embodiments incorporating fiber optic sensors the signal processor 24 includes an optical signal processor and sensor interrogation means joined to the sensor 14. The controller 22, for example, is capable of controlling the motor 20 in response to signals from the signal processor 24. The controller or central computer 22 can be local or remote, and can be linked to external controllers (not shown) through an external data link 26, for example, fiber optic cables, underwater acoustic communications, or satellite link. The present invention also contemplates an external signal processor and/or controller that is outside of the platform 2, to which the signals are transmitted and remotely processed.

According to one embodiment, the retractable sensor array system 10, FIG. 2, includes multiple sensor array sheets **12*a*, 12*b*. A first sensor array sheet 12*a*, for example, is deployed from a starboard side 4 of the platform 2, such as a ship or submarines while a second sensor array sheet 12*b* is deployed from a port side 6 of the platform 2. Providing sheets on both the starboard side 4 and port side 6 provides left/right signal ambiguity resolution as well as a back up capability. One or more motors 20 are used to selectively deploy and retract each of the sensor array sheets 12*a*, 12*b* depending upon the desired usage. Each of the sensor array sheets 12*a*, 12*b* also include a sensor array sheet support member 30, such as one or more weighted members 32**.

Figure 3:
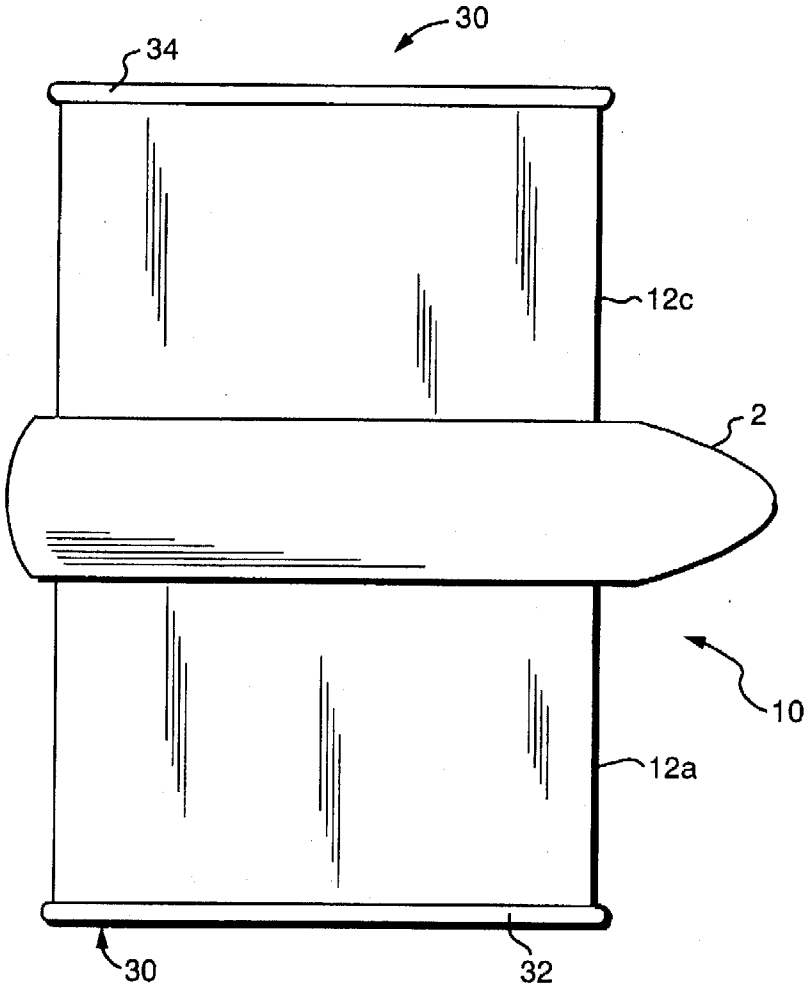
FIG. 3 is a side schematic view of a retractable sensor array system, according to the present invention, having sensor array sheets extending in opposite directions, according to a further embodiment of the present invention.

According to a further embodiment, the retractable underwater sensor array system 10, FIG. 3, includes sensor array sheets **12*a*, 12*c* extending in different directions with respect to the platform 2. For example, a first sensor array sheet 12*a* may extend in a substantially downward direction with respect to the platform 2 while a second sensor array sheet 12*c* extends in a substantially upward direction with respect to the platform 2. Alternatively, the sensor array sheets may be deployed horizontally, or at an angle, left and right side of platform 2 A sensor array sheet 12*c* extending in a substantially upward direction in an underwater environment includes a sensor array sheet support member 30 such as a flotation support member 34. The flotation support member 34 facilitates the extension of the sensor array sheet 12***c* in an upward, vertical direction to maximize the aperture or area of the sensor array.

The direction and location of each sensor array sheet 12 in a retractable sensor array system 10 will depend upon the type and location and deployment medium of platform 2 as well as the desired usage. A surface ship, such as a commercial fishing vessel, would only require a sensor array sheet 12 that extends in a substantially downward direction. In another example, an underwater platform located on or near the sea bottom would only require sensor array sheets 12 that extend in a substantially upward direction. Other uses and examples are considered to be obvious to one skilled in the art and within the scope of the present invention.

Figure 4:
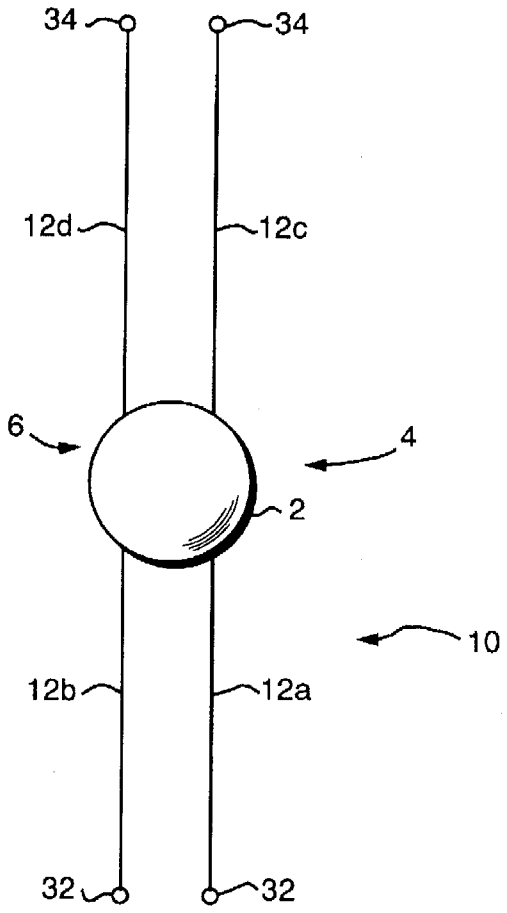
FIG. 4 is a rear schematic view of a retractable sensor array system, according to the present invention, having four sensor array sheets extending in opposite directions and from different sides of a platform, according to a further embodiment of the present invention.

In one example, the retractable sensor array sheet 10, FIG. 4, includes four sensor array sheets 12*a*–12*d*. A first sensor array sheet 12*a* extends substantially downward on the starboard side 4 of the platform 2, a second sensor array sheet 12*b* extends substantially downward on the port side 6, a third sensor array sheet 12*c* extends substantially upward on the starboard side 4, and a fourth sensor array sheet 12*d* extends substantially upward on the port side 6. One or all of the sensor array sheets 12*a* –12*d* can be selectively deployed depending upon the location and position of the platform 2 and the desired usage. Which one(s) of the sensor array sheets 12*a*–12*d* are deployed also depends upon other conditions, such as ocean currents, environmental factors, deployment medium, platform orientation, velocity and depth, and water depth if applicable. The retractable sensor array system 10 according to the present invention is capable of automatically detecting or sensing such conditions and deploying the desired sensor array sheet or sheets 12*a*–12*d*.

The present invention contemplates any number of sensor array sheets and deployment from any location on a platform or in any possible direction. On a torpedo, for example, one or more sensor array sheets could be deployed in a substantially horizontal direction on either side of the torpedo.

Figure 5:
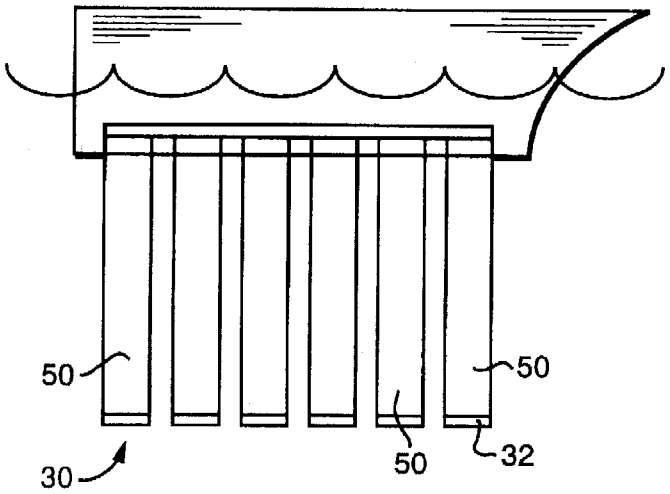
FIG. 5 is a side schematic view of a retractable sensor array system, according to the present invention, having a series of sensor array sheets, according to a further embodiment of the present invention.

According to an alternative embodiment, the retractable sensor array system 10, FIG. 5, includes a series of sensor array sheets 50, for example, formed as strips. Each sensor array sheet or strip 50 includes one or more of the support members 30, such as weighted support members 32.

Figure 6:
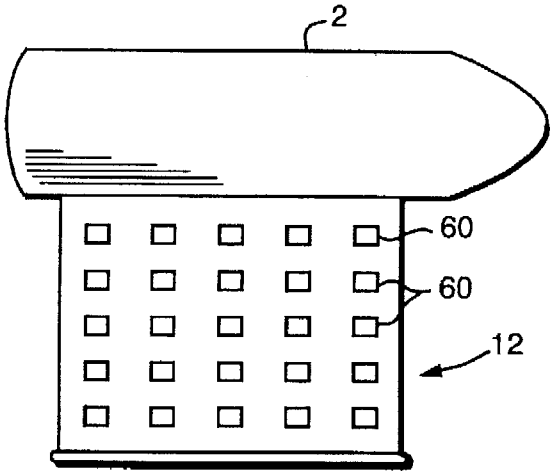
FIG. 6 is a side schematic view of a retractable sensor array system, according to the present invention, having a sensor array sheet with holes, according to a further embodiment of the present invention.

In another alternative embodiment, the sensor array sheet 12, FIG. 6, includes one or more holes 60 extending through the sensor array sheet 12 to reduce the hydrostatic drag created by air or ocean currents or the motion of the platform 2 through the deployment medium.

Figure 7:
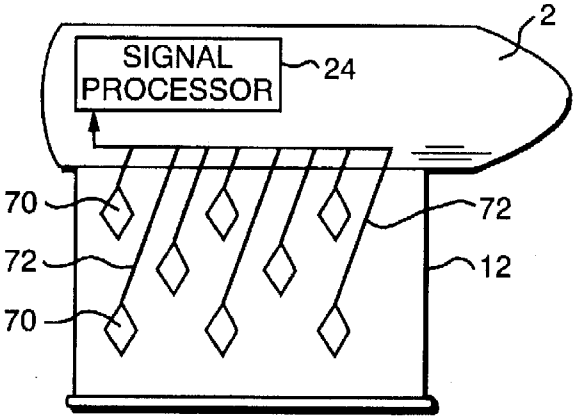
FIG. 7 is a schematic side view of a retractable underwater sensor array system, according to the present invention, having a plurality of hydrophones, according to a further embodiment of the present invention.

According to a further alternative, the sensor array sheet 12, FIG. 7, such as a polymer sheet, is constructed of individual "tile-like" hydrophones 70. Each hydrophone 70 is coupled to signal processor 24 located on platform 2, for example, using signal wires 72. Such hydrophones 70 may be, for example, classical piezo-electrical transducer (PZT) tiles or other sensing devices.

Accordingly, the retractable underwater sensor array system provides a large aperture sensor array that can easily be deployed from a platform, such as a surface ship, submarine, or other vessel, vehicle or deployment device. The retractable underwater sensor array system also provides a large aperture sensor array that can be selectively and automatically deployed from various locations on a platform and in various directions depending on the required usage and the existing medium and deployment conditions. The retractable sensor array system also provides a large aperture sensor array that can effectively be towed by a vehicle and can withstand underwater and other similar conditions while maintaining the large aperture necessary for effective receipt of energy or signals.

In light of the above, it is therefore understood that within the scope of the appended claims, the invention may be practiced otherwise than as specifically described.

What is claimed is:

1. A retractable sensor array system comprising:

at least one sensor array sheet having at least one sensor element disposed on at least one surface of said at least one sheet; and a sensor array positioning mechanism having a roller mechanism coupled to said at least one sensor array sheet, said at least one sensor array sheet rolling and unrolling on said roller mechanism for deploying and retracting said at least one sensor array sheet into the environment.

2. The retractable sensor array system of claim 1 further comprising at least one sensor array sheet support member coupled to an end of said at least one sensor array sheet for urging and supporting said at least one sensor array sheet in a deployed position distal from said sensor array positioning mechanism.

3. The retractable sensor array system of claim 2 wherein said at least one sensor array sheet support member includes a weighted support member for urging and supporting said at least one sensor array sheet in a substantially downward direction with respect to said sensor array positioning mechanism.

4. The retractable sensor array system of claim 2 wherein said at least one sensor array sheet support member includes a flotation support member for urging and supporting said at least one sensor array sheet in a substantially upward direction with respect to said sensor array positioning mechanism.

5. The retractable sensor array system of claim 1 wherein said at least one sensor array sheet is made from a polymer.

6. The retractable sensor array system of claim 1 wherein said sensor array positioning mechanism further includes a motor coupled to said roller mechanism for automatically rolling and unrolling said at least one sensor array sheet.

7. The retractable sensor array system of claim 6 further including a controller coupled to said motor for controlling deployment and retraction of said at least one sensor array sheet.

8. The retractable sensor array system of claim 1 wherein said at least one sensor array sheet includes a plurality of sensor array sheets.

9. The retractable sensor array system of claim 8 wherein each of said plurality of sensor array sheets are adapted to be selectively and independently deployed and retracted by said sensor array positioning mechanism.

10. The retractable sensor array system of claim 1 wherein said at least one sensor array sheet includes at least first and second sensor array sheets.

11. The retractable sensor array system of claim 10 wherein said first sensor array sheet extends in a substantially upward direction with respect to said sensor array deploying mechanism, and said second sensor array sheet extends in a substantially downward direction with respect to said sensor array deploying mechanism.

12. The retractable sensor array system of claim 10 where said first array sheet extends from a starboard-side of the deployment platform, and wherein said second array sheet extends from a port-side of the deployment platform.

13. The retractable sensor array system of claim 1 wherein said at least one sensor array sheet has at least one hole extending therethrough for reducing environmental drag.

14. The retractable sensor array system of claim 1 further including a signal processor coupled to each said at least one sensor element disposed on said at least one sensor array sheet for processing signals received from each said at least one sensor element.

15. The retractable sensor array system of claim 14 further including a controller coupled to said signal processor for controlling signal processing by said signal processor.

16. The retractable sensor array system of claim 1 wherein said at least one sensor array sheet includes a plurality of hydrophone elements.

17. The retractable sensor array system of claim 1 wherein said at least one sensor array sheet includes at least first, second, third and fourth array sheets adapted to be selectively and independently deployed and retracted by said sensor array positioning mechanism.

* * * * *